United States Patent [19]

McCarthy

[11] Patent Number: 4,775,328

[45] Date of Patent: Oct. 4, 1988

[54] MODULAR SEVEN WIRE ELECTRICAL CONNECTOR SYSTEM

[75] Inventor: David G. McCarthy, Huntington, Conn.

[73] Assignee: Electri-Cable Assemblies, Inc., Shelton, Conn.

[21] Appl. No.: 751,617

[22] Filed: Jul. 2, 1985

[51] Int. Cl.[4] ..... H01R 13/658

[52] U.S. Cl. ..... 439/211; 439/607

[58] Field of Search ..... 339/22 R, 22 B, 21, 339/20, 23, 24, 143 R; 174/48, 49; 439/607–610, 110–122, 207–213

[56] References Cited

U.S. PATENT DOCUMENTS

| | | | |
|---|---|---|---|
| 3,854,001 | 12/1974 | Dola | 174/48 |
| 4,255,610 | 3/1981 | Textoris | 174/48 |
| 4,278,834 | 7/1981 | Boundy | 339/22 R |
| 4,433,630 | 2/1984 | Laborie | 174/48 |
| 4,557,177 | 12/1985 | Cheney | 339/143 R |

*Primary Examiner*—J. Patrick McQuade
*Attorney, Agent, or Firm*—F. Eugene Davis, IV

[57] ABSTRACT

The present invention provides a modular electrical power block assembly including a plurality of ports for receiving individual modular circuits. The power block assembly includes seven separate electrical conductors, three of which are hot, two of which are neutral and two of which are ground, for providing three separate and independent circuits. The hot wire of one of the circuits is advantageously separated from the hot wires of the remaining two circuits by two grounds and two neutrals and one circuit may be shielded to prevent penetration of electro-magnetic interference from the other circuits. Individual circuit modules are adapted to be received within individual ports of the power block for selectively completing one or more of the three independent circuits provided by the power block assembly. The contacts extending from the individual circuit modules are arranged to engage only preselected wires within the power block assembly for completing a predetermined circuit. Although the circuit modules are mechanically interchangeable with respect to the ports on the power block, they are not electrically interchangeable and will establish the same circuit in any port in which they are received. The present system may be advantageously mounted by sliding a mounting bar on top of the power block into an overhead bracket in lieu of the use of conventional mounting means such as screws or bolts. A tool is provided for conveniently removing individual circuit modules from ports in the power block in one simple step.

24 Claims, 10 Drawing Sheets

CROSS SECTION OF POWER MODULE

CROSS SECTION OF RACEWAY

CROSS SECTION OF FESTOON

MODULAR SEVEN WIRE ELECTRICAL CONNECTOR SYSTEM

TECHNICAL FIELD

The present invention is directed to electrical connector assemblies or receptacles and is more particularly directed to an improved power block assembly having a plurality of separate ports defined therein for selectively receiving one or more individual circuit modules for establishing one or more electrical circuits.

BACKGROUND ART

Power block assemblies including a port for receiving duplex circuit units are known to the art. Such power blocks are intended to be mounted to the bottom of a wall panel in an office for providing an electrical receptacle for various office equipment. One known unit is sold by AMP, Inc. of Harrisberg, Pa. and is referred to as "Duplex Receptacle, Panel Pack II Six Wire System". There are several disadvantages inherent in the AMP Duplex. Since it is a duplex, the user does not have the capability to balance the electrical load on individual receptacles serving different types of equipment. No means are provided for inserting only a single modular circuit into the power block. Moreover, the wiring of the AMP device runs three hot circuit wires adjacent to one another and each of the three circuits must share either a neutral or a ground. Accordingly, no isolated circuit is provided. Additionally, the power assembly block must be installed by conventional means such as screws or bolts to the bottom of a wall panel, the top of a wall panel, or the top and bottom, and no easy means are provided for removing the duplex circuit unit when it is received in the port of the power block. Therefore, the removal of the circuit unit from the port requires the dangerous insertion of a probe like object, as for example a screw driver, into two separate locking means defined on opposed sides of the power block.

Other known power distribution systems are illustrated by U.S. Pat. No. 4,165,443 (Figart et al), U.S. Pat. No. 4,386,333 (Dillan); and U.S. Pat. No. 3,922,478 (Perkey). The Dillan patent discloses an electrical receptacle provided in an electrical device and adapted to be connected to a source of line voltage. A rotatable member and switch associated with the receptacle assure that only a preselected plug may be received in the receptacle. The switch is operatively associated with a voltage converter and assures that the voltage supplied to the device itself will be constant irrespective of the line voltage.

The Perkey patent discloses an apparatus which may be used as a duplex receptacle, a junction box, or a three way switch.

The Figart et al patent discloses an electrical distribution box adapted to receive power cables and distribution cables inserted therein.

None of the above discussed power distribution systems suggests a power block assembly having seven separate wires to provide three independent circuits in which the live or hot wire for one of the circuits is separated from the live or hot wires of the other circuits by two grounds and two nuetrals. Moreover, none of the known systems suggest a power block assembly including a plurality of separate but identical ports for receiving separate individual circuit modules for completing predetermined electrical circuits which are mechanically interchangeable (but not electrically interchangeable) and may be received in any of the ports in the power block assembly. Additionally, none of the known systems suggests a power block assembly which may be readily mounted to the bottom of a wall panel by sliding it into a bracket, or a tool for easily removing a single circuit module from a receptacle in a single step to avoid the dangers inherent in the insertion of probe-like members to remove a circuit module form a power block.

It is the object of the present invention to provide an electrical distribution system exhibiting the advantages noted above which are not recognized by the known systems.

More specifically, it is an object of the present invention to provide an electrical distribution system including a power block defining a plurality of ports for selectively receiving individual circuit modules to establish predetermined electrical circuits.

It is another object of the invention to provide a system in which each of the circuit modules may be received in an port in the power block and will establish only a predetermined electrical circuit in any port.

It is a further object of the invention to provide a system having seven electrical conductors in which one live conductor is separated from two other live conductors by two grounds and two neutrals.

It is a further object of the invention to provide a system having an isolated and shielded computer circuit.

It is a further object of the invention to provide a system in which the power block may be readily mounted and dismounted by sliding a mounting bar carried on the power block into a complementary shaped bracket.

It is still a further object of the invention to provide a system including a tool for removing circuit modules from the power block in a single step with the insertion of electrically conductive probe-like objects therein.

Other objects and advantages of the invention will become apparent as the invention is more fully described herein.

SUMMARY OF THE INVENTION

An electrical distribution system includes a power block assembly defining a plurality of independent but identical ports. Each port is adapted to receive a single circuit module for completing a pre-determined electrical circuit. Although the ports in the power block assembly are identical and any of the different circuit modules may be received in any port on the assembly, the circuit modules can only complete a predetermined circuit independent of the specific part in which part they are received. Accordingly, although the circuit modules are mechanically interchangeable with respect to the power block assembly, they are not electrically interchangeable.

The power block assembly of the present system includes seven wires (three hot wires, two grounds and two neutrals) which are adapted to define three independent circuits when the appropriate circuit modules are received in the power block. The wiring is arranged such that the hot wire of one circuit is separated from the two other hot wires by two grounds and two neutrals. A computer circuit may be defined by a hot wire, an isolated neutral and an isolated ground which are shielded from the other conductors within the connecting cables to eliminate electro-magnetic interference from the other circuit wires.

The power block includes a mounting bar carried on its upper surface and may be readily mounted to the underside of a wall panel by sliding the mounting bar into an overhead bracket mounted to the bottom of a panel. In this manner the power block assembly may be readily mounted and dismounted without the use of inconvenient conventional mounting means such as bolts or screws.

The individual circuit modules received in the power block assembly are arranged such that the opening in each module for receiving the ground pin of a plug inserted in the module is uppermost when such plug is inserted into a circuit module. In this manner if the plug is not fully inserted into the module and the plug contacts are partially exposed, any articles falling downwardly on to the exposed portions will strike the ground pin and not a live contact. This arrangement helps to avoid any potential electrical accidents that might otherwise be caused by such exposed contacts.

The present invention also provides a convenient tool for removing any circuit module from a port in the power block assembly. Since all modules are mechanically interchangeable with respect to any port in the assembly, the same tool may be used for extracting any module from any port. The tool advantageously provides a quick and convenient way of removing a module from a port in a single step and avoids the dangerous insertion of probe-like objects to remove the circuit modules. The use of the module removal tool also restricts access to only authorized personnel using the tool.

DESCRIPTION OF THE BEST MODE FOR CARRYING OUT THE INVENTION

Figure 1:
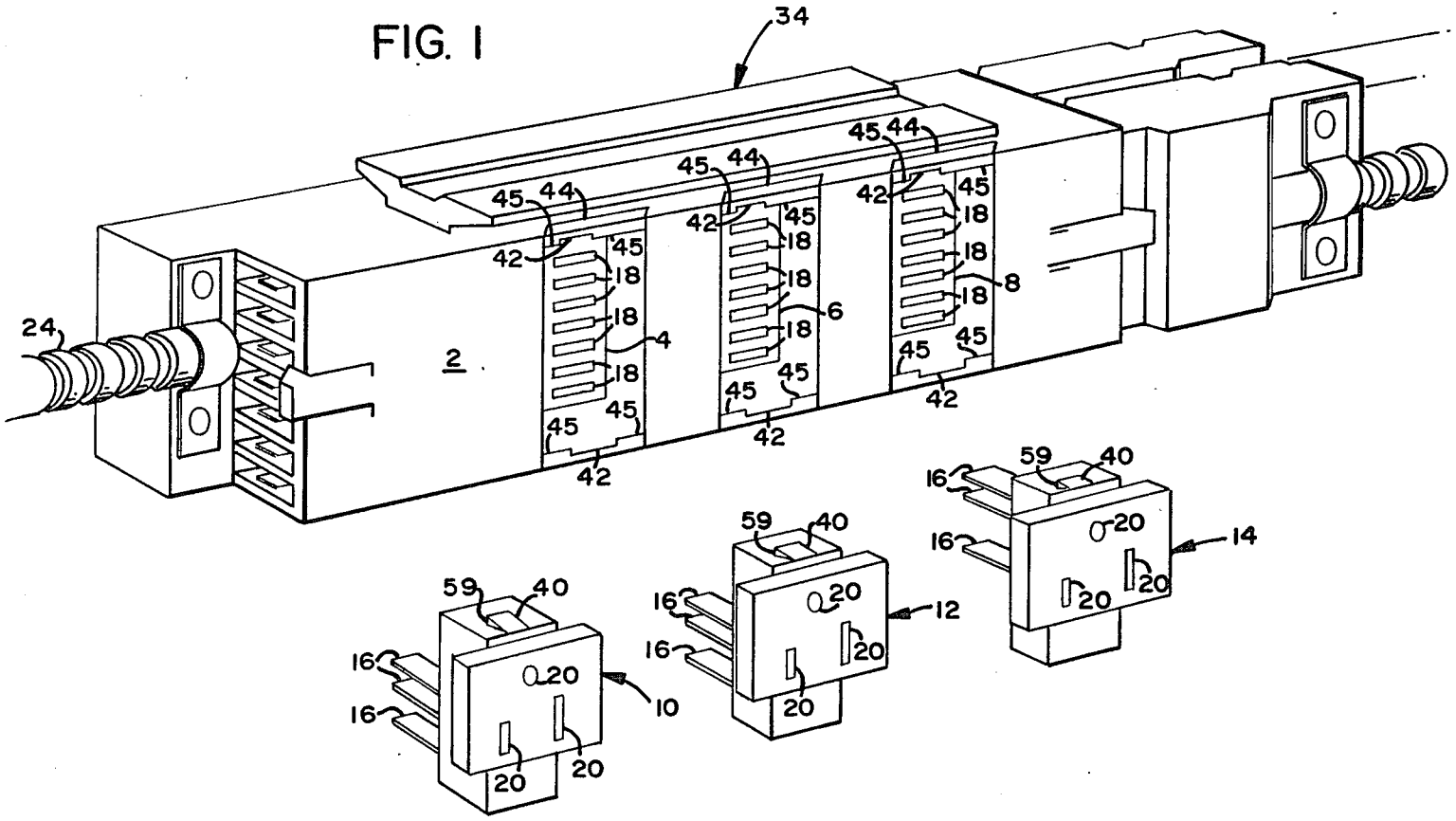
FIG. 1 of the drawings is a perspective view of the electrical distribution system of the present invention illustrating a power module having a plurality of ports, a power cable coupled to the power module, and a plurality of circuit modules which may be inserted into the ports of the power module.
Figure 2:
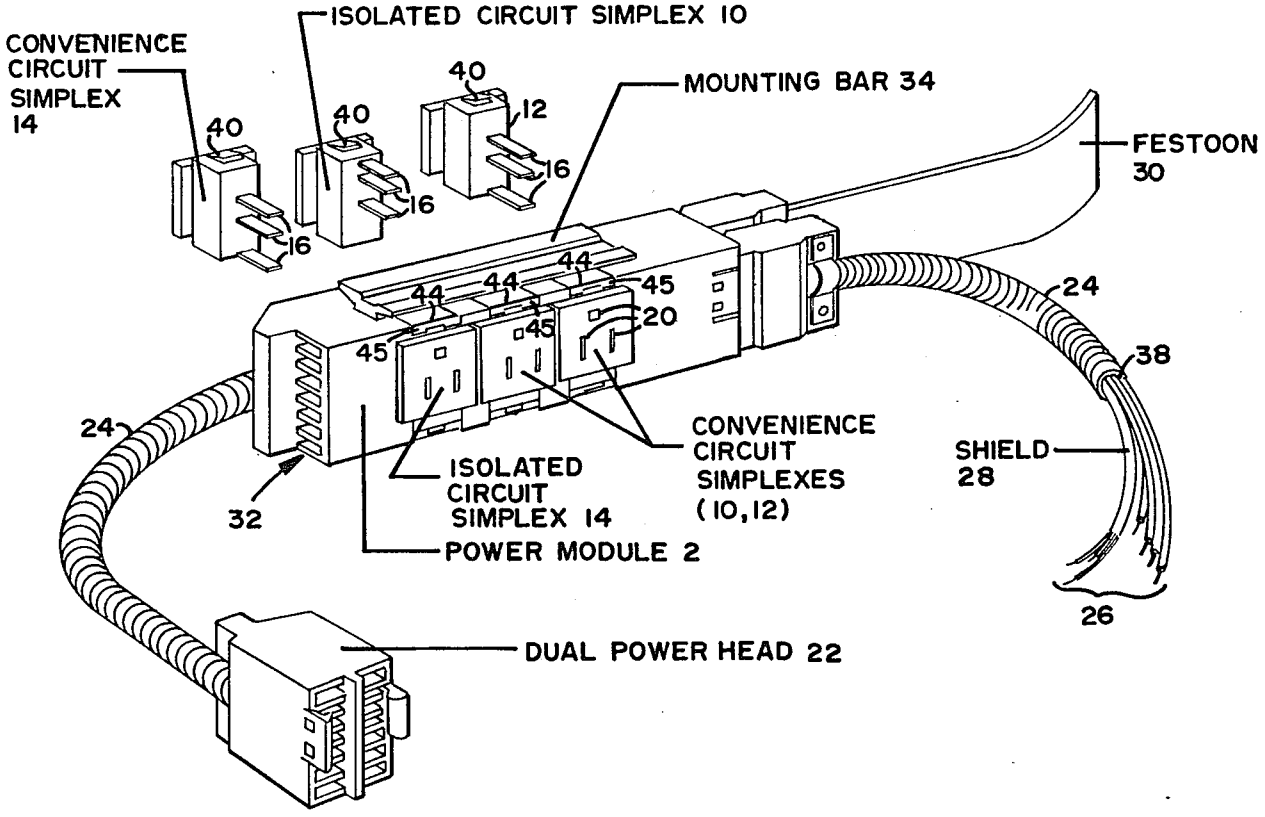
FIG. 2 of the drawings illustrates the power module of FIG. 1 showing the circuit modules received in the ports.
Figure 3:
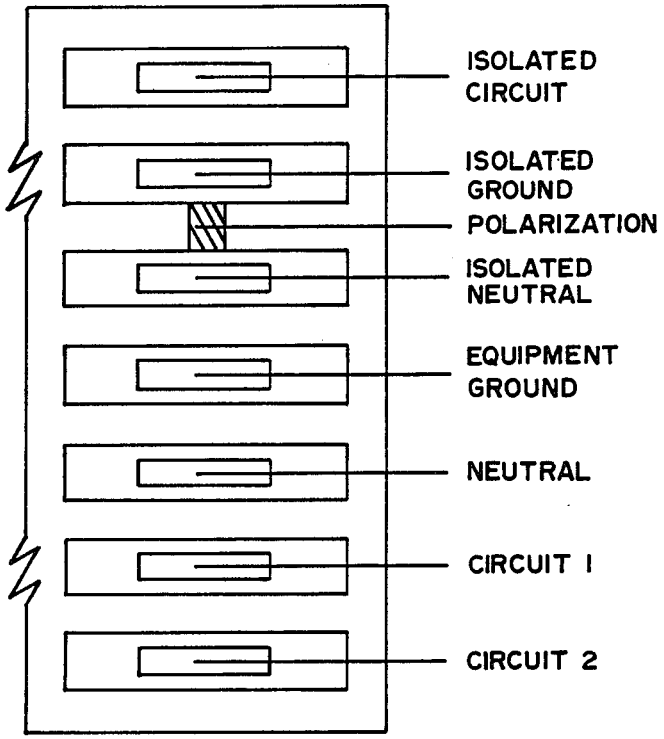
FIG. 3 illustrates a cross-section of the power module.

The different aspects of the present invention will now be discussed with reference to FIGS. 1 through 10 of the drawings. Referring first to FIGS. 1 and 2, these drawings illustrate perspective views of the overall power distribution system of the present invention. An elongated power block module is generally designated by the reference numeral 2. This power module includes a plurality of ports designated by the reference numerals 4, 6, and 8. The opposed side of the power module (not shown in FIGS. 1 or 2) also defines a similar number of ports. In the preferred embodiment of the invention, each side of the power block module defines three separate adjacent ports. A plurality of circuit modules, designated by reference numerals 10, 12, and 14, are shown in perspective in FIG. 1 of the drawings. Each of these circuit modules includes three electrical prongs 16 extending from the front surface of the circuit modules. As also shown in FIG. 1, each of the ports 4, 6 and 8 defined on the power module includes seven parallel slots 18. Any of the circuit modules 10, 12 or 14 may be received in any of the ports 4, 6 or 8 defined on the power module, as illustrated in FIG. 2 of the drawings. When a circuit module is received in a port, the three electrical prongs 16 are received in three corresponding slots 18 in the respective port. As will be discussed more fully hereinafter, the slots 18 of a port in which the prongs of a circuit module are received define the circuit connection made by that circuit module. As further illustrated in FIG. 2, the rear surfaces of the circuit modules 10, 12, and 14 each define three openings 20 for receiving live, neutral and ground contacts of a plug connector inserted therein.

As also shown in FIGS. 1 and 2 a dual power head 22 is coupled to the power module 2 via a power cable 29. This cable may be electrically coupled to all hot wires in the power block 2 through one of the ports defined in the power block. The cable consists of seven separate wires generally designated by the reference numeral 26, three of these wires being enclosed within a shield 28. A festoon 30 is also electrically coupled to the power module 2 and a plurality of slots 32 defined on one end of the power module are provided for electrically coupling a power take-off (not shown in the drawings) to the power module unit. A mounting bar 34 extends upwardly from the upper surface of the power module. As will be discussed below, this mounting bar is used to readily and conveniently mount the power module by sliding it into a complementary shaped bracket.

Except for the orientation of the electrical prongs 16, the physical configuration of the plurality of circuit modules 10, 12 and 14 are identical. As noted above, any of these circuit modules may be received in any of the ports defined in the power module 2. However, the circuit established by the specific circuit module, regardless of the port in which it is received, will be defined only by the orientation of the prongs 16 on the individual circuit module which determines which three slots 18 in the port receive the prongs. Accordingly, the system of the present invention advantageously provides individual circuit modules which are mechanically, but not electrically, selectively interchangeable with respect to the individual ports defined in the power module. Stated in other words, although any circuit module may be received in any port, the circuit module will always establish the same circuit connections regardless of the port in which it is received.

Referring now to FIGS. 3, 4, 5, and 10, the electrical wiring of the present invention is disclosed in greater detail. It is seen from these drawings that the seven parallel slots 18 defined in the ports of the power module are respectively aligned with and correspond to seven corresponding parallel electrical conductors which extend longitudinally through the power module 2. The electrical conductors are arranged from top to bottom of the power module with one hot electrical conductor being uppermost, followed in descending order by two ground conductors, two neutral conductors, two additional hot electrical conductors. This wiring arrangement advantageously provides three separate circuits. Preferably, two convenience circuits are defined by the two lowermost electrical conductors which have a common ground and a common neutral. A third circuit may be established by the uppermost hot electrical conductor and the remaining ground and neutral electrical conductors. Preferably, the ground and neutral conductors used in the third circuit are the ground and neutral conductors which are immediately adjacent to the uppermost live conductor.

Figure 10:
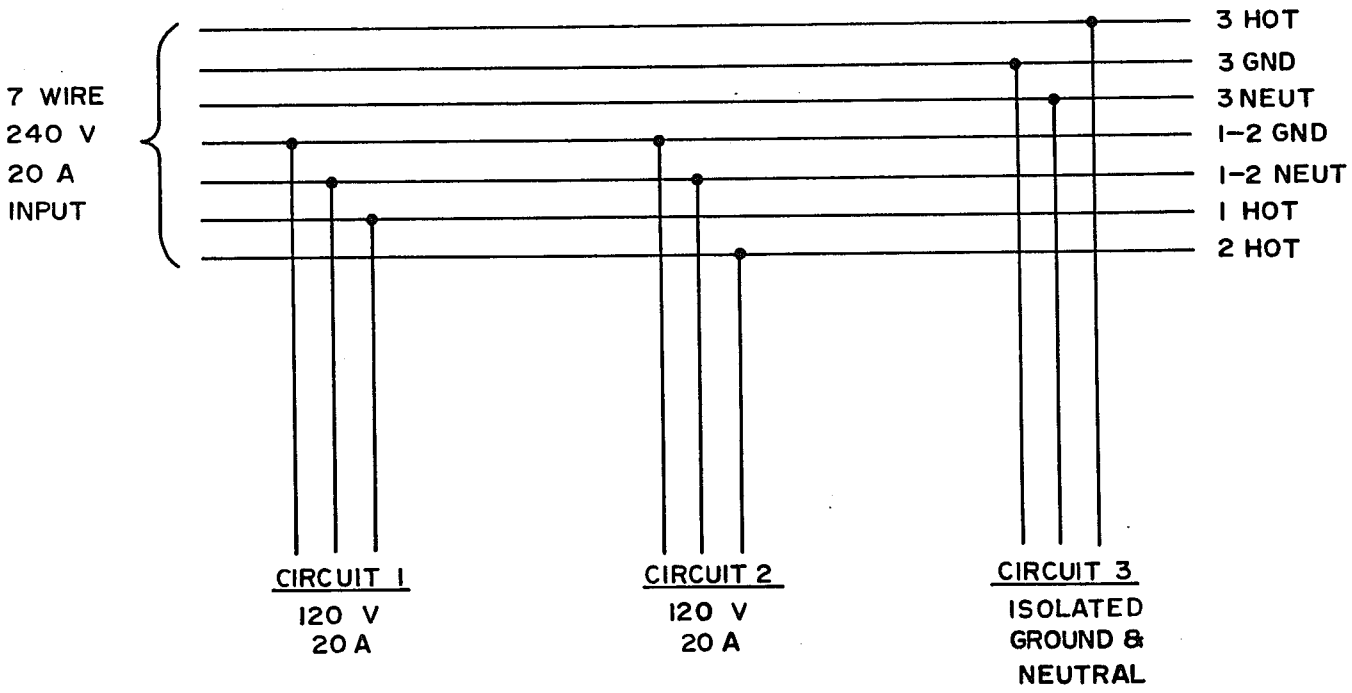
FIG. 10 is a schematic diagram of the wiring within the power module and the manner in which three different circuit modules may be electrically established.

FIG. 10 is a schematic diagram showing the connections made when three different circuit modules are inserted into three different ports on the power module. Each of the circuits 1, 2 and 3 represents a different circuit module inserted into a different port. Insertion of a circuit module into a port results in electrical contact between the three prongs on the circuit module and three of the conductors in the power module which are aligned with the three slots in the port through which the three prongs pass. It is seen that circuit 1 is established by the electrical connection of one hot wire, one ground, and one neutral, made by the prongs of a first circuit module. Circuit 2 is established by a second hot conductor and the same neutral and ground conductors employed by circuit 1. However, circuit 3 is established by the connections between the prongs of a circuit module and the uppermost hot electrical conductor and the remaining, non-common, ground and neutral conductors. Circuit 3 is isolated from circuits 1 and 2 and does not share any common conductors with those other circuits. Either one, two or three different circuits may be selectively established by the user by inserting the appropriate circuit module or modules in any port in the power block 2. Because each circuit is established by the orientation of the prongs of the circuit module, the same electrical connections will be made by a specific circuit module regardless of the specific port in which the circuit module is received. As illustrated in FIGS. 1 and 2, the specific individual circuit modules establishing the different circuits are clearly labeled for identification purposes.

The seven wire or conductor orientation of the power block 2 is advantageous in many respects. Unlike prior art devices which provide two neutrals and a single ground shared with all circuits, the circuits established by the seven wire orientation of the present invention provide two neutrals and two grounds to establish two separate convenience circuits with common neutrals and common grounds and one isolated circuit having an isolated neutral and an isolated ground not shared with any other circuit. Preferably, the isolated circuit, which is designated as circuit 3 in FIG. 10, may be used as a "computer" circuit. As is clear from FIGS. 3 and 10, the orientation of the conductors in the power block assures that the hot wire for the "computer" circuit will be physically speparated from the hot wires of the respective convenience circuits 1 and 2 by two neutrals and two grounds. This orientation advantageously separates the computer circuit from the remaining circuits to reduce or eliminate electro-magnetic interference from the hot conductors of the other two circuits. Electro-magnetic interference may adversely affect the computer circuit resulting in lost or inaccurate data.

Figure 5:
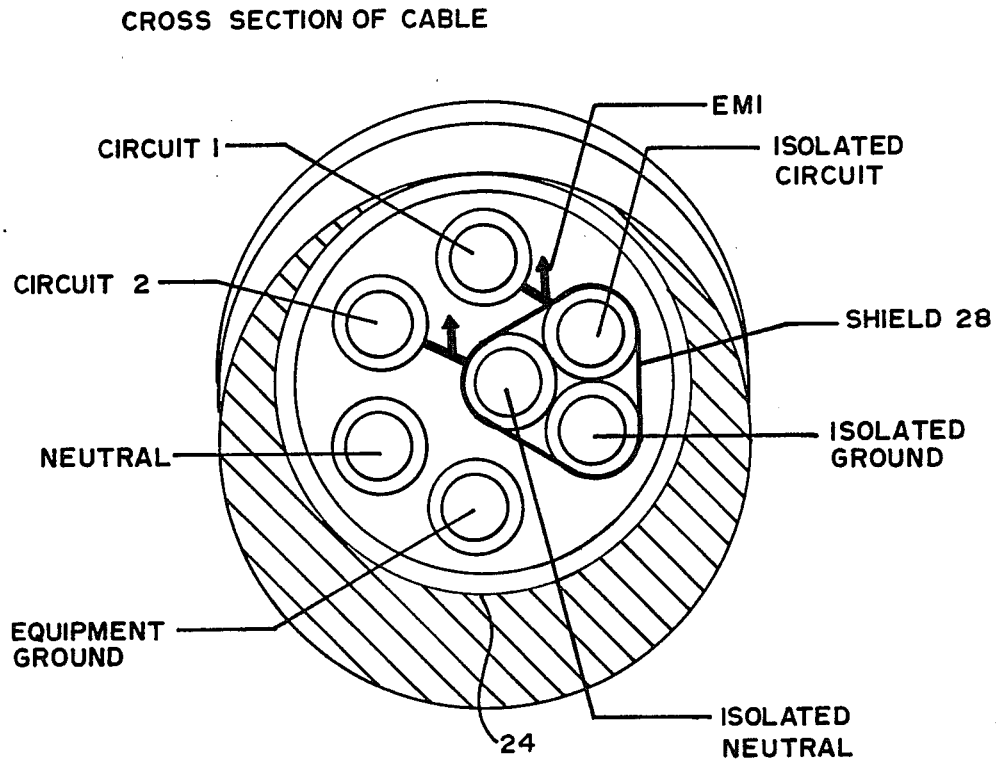
FIG. 5 illustrates a cross-section of the power cable coupled to the power module.

As further illustrated in FIGS. 2 and 5, the wires and conductors forming the computer circuit may be further isolated from the remaining wires and conductors by a shield 28 surrounding the wires establishing the computer circuit to prevent penetration of electro-magnetic interference from the live wires and conductors of convenience circuits 1 and 2. The metallic shield 28 surrounding the isolated computer circuit provides a barrier which reflects electro-magnetic interference that may be radiated from the other circuits to prevent penetration and interference with the computer circuit.

Figure 4:
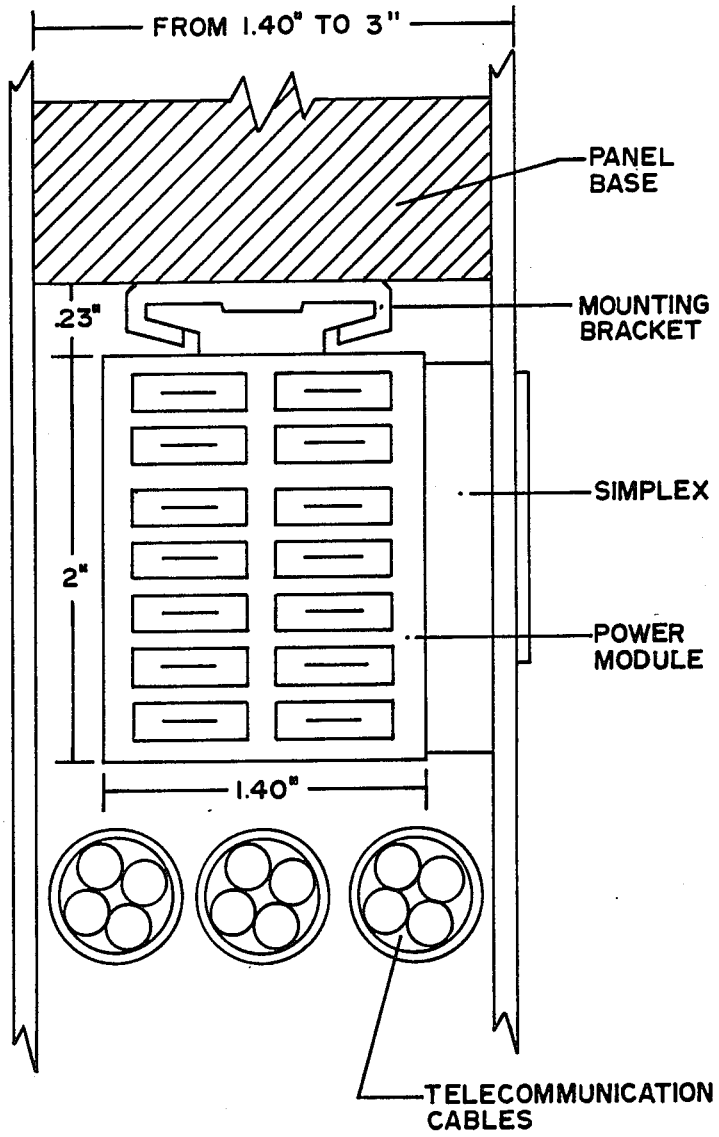
FIG. 4 illustrates a cross-section of the entire raceway in which the power module is enclosed.

Referring specifically to FIG. 4 of the drawings, a cross-section of a raceway enclosing the power module of the present invention is illustrated. The raceway provides an adjacent pair of parallel seven wire conductors arranged in elevated order as discussed above, each one of the sets of conductors being oriented towards a different side of the raceway. In this manner, as discussed above, separate individual ports may be defined on either side of the power module 2 illustrated in FIGS. 1 and 2 of the drawings. The raceway itself is compact to allow for computer signal and telecommunication cables to pass through it. Preferably, the raceway is 2 inches high and 1.4 inches in width, the overall height of the raceway being about 2.2 inches when the height of the mounting bar 34 is considered.

Figure 6:
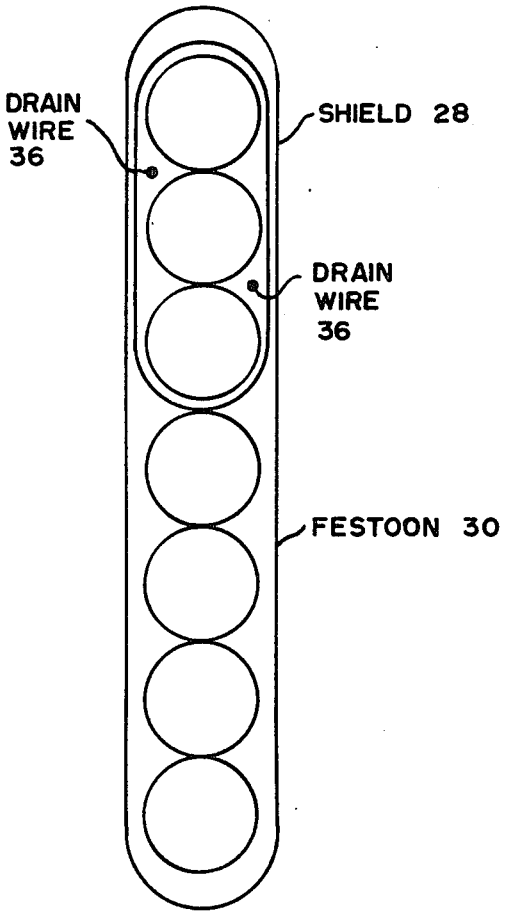
FIG. 6 illustrates a cross-section of a festoon which is also electrically coupled to the power module.

Referring now to FIG. 6 of the drawings a crosssection of the festoon 30, illustrated in FIG. 2, is shown. The festoon is electrically coupled to the seven electrical conductors in the power module 2 for receiving electrical power from a power source. The festoon itself is a narrow band including the seven wire orientation corresponding to the electrical conductors which run through the power module. As illustrated in FIG. 6, the wires forming the isolated "computer" circuit, discussed above, are enclosed within a surrounding metal shield 28 for preventing electro-magnetic interference from the other circuits from penetrating the computer circuit. Additionally, drain wires designated by the reference numeral 36 are included within the shielded computer circuit to provide a low impedance path for unwanted signal noise to the common equipment ground. The purpose of the festoon is to provide means for electrically connecting different power modules. The festoon is both flexible and narrow and may fit into or around spaces that a cable could not. Accordingly, when the end 38 of the power cable 24 (see FIG. 2) is not capable of coupling power module 2 to a similar power module because of space requirements, the narrow festoon 30 may be employed to make the necessary electrical connections.

As noted above, the power cable 29 (FIGS. 1 and 2) for electrically coupling power block 2 to a power source and for electrically coupling different power blocks also includes a metallic shield 28 for shielding the isolated computer circuit as illustrated in FIG. 5.

Figure 7:
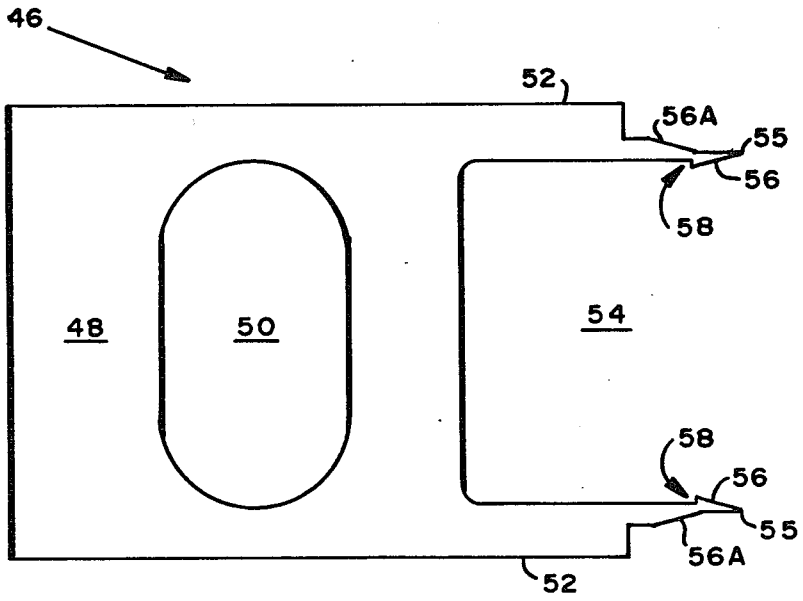
FIG. 7 illustrates a perspective view of a tool used to conveniently remove circuit modules from their respective ports in the power module.
Figure 8:
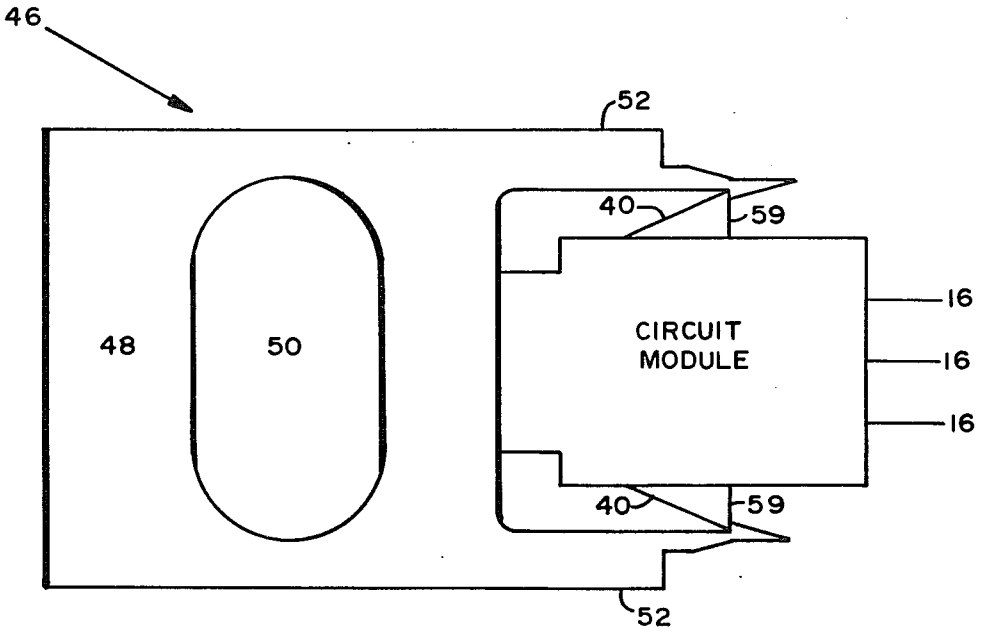
FIG. 8 illustrates a diagramatic side view of the tool of FIG. 7 engaging a circuit module for removal thereof.

Referring now to FIGS. 7 and 8, these drawings illustrate a new tool which is useful for removing an individual circuit module received in a port on the power module in a single operation. It is initially noted that each circuit module includes ramps designated by the reference numeral 40 on both the top and bottom surfaces of the module. These ramps, which may be integrally defined on the circuit module, are inclined in an upward direction towards the rear surface of the power block when the circuit module is received in a port in the power block. The rear ends of the ramps define a surface 59 which is perpendicular to the top of the circuit modules. The ports in the power block are suitably configured to define complementary spaces for receiving the ramps of the circuit modules, as designated by reference numeral 42 in FIG. 1. The upper and lower walls of the ports in the power module, designated by reference numerals 44 on FIGS. 1 and 2, are formed from a flexible material, as for example, a durable plastic. The upper and lower walls 44 of the port also include downwardly extending tab sections 45, as shown in FIGS. 1 and 2, which engage portions of a circuit module to retain it in the port.

FIG. 7 of the drawings illustrates a tool for readily removing the circuit modules from the ports. This tool may also be formed from a durable non-electrically conductive material, as for example a LEXAN plastic. The tool itself is designated generally by the reference numeral 46 and includes a handle section 48 defining a central opening 50 so that the tool may be firmly gripped by the user. The tool includes two spaced parallel members or resiliant arms 52 which extend integrally from the handle section of the tool, defining an open space 54 therebetween. The ends of both members 52 define points 55 and inwardly directed ramps 56 which terminate in ledges 58 which are oriented perpendicularly to the members 52. The ledges 58 are directed inwardly into the open space 54 defined between the members 52. The maximum distance between the members 52 through the space 54 is substantially equal to the height of a circuit module inserted into a port in the power module. The distance between the the respective ramp sections 56 at the points in which they terminate at ledges 58 is less than the height of a circuit module inserted into a port in the power module.

Removal of a circuit module with tool 46 will be explained as follows. The points 55 of the tool are inserted into the upper and lower ends of the port above and below the ramps 40 on the modules such that the ramps 56 on the opposed resilient arms 52 of the tool ride over the outside of the ramps 40 defined on the top and bottom of the circuit module. Ramps 56 defined on the inner surface of members 52 on the tool, and ramps 56A defined on the outer surface of members 52 cooperate with the ramps 40 defined on the circuit module to force or wedge the flexible upper and lower walls of port 44 away from the circuit module as the tool 46 is inserted into the port. The tool is inserted into the port until the circuit module is received within the open space 54. At that point, ledges 58 grip the top and lower portions of the inner surface of the circuit module including the elevated rear surface 59 of the ramp 40, as shown in FIG. 8. This circuit module is retained within the inner space 54 of the tool by the ledges 58 as the tool is withdrawn from the port. Accordingly, withdrawal of the tool also removes the circuit module from the port. The use of the tool 46 as disclosed herein and the cooperating ramps 40 on the circuit modules themselves renders it difficult, if not impossible, for any person not possessing the tool to remove the circuit module from the power block. Therefore, only authorized persons having possession of the tool may remove circuit modules. Unlike the prior art, use of the tool eliminates the insertion of dangerous probe-like objects, such as electrically conductive screwdrivers, into the ports which contain live electrical conductors.

A further safety aspect of the present invention is illustrated by FIG. 2 of the drawings. In this figure, it is seen that when the circuit modules are properly inserted into the ports on the power module (e.g., such that the labeling on the circuit modules is correctly oriented with respect to a user), the opening in the module for receiving for the ground pin of a plug to be inserted into the circuit module is positioned higher than the openings defined in the circuit module for receiving the neutral and live electrical plug contacts. Contacts within each circuit module are provided to assure that the ground pin opening in the front surface of the circuit module is uppermost notwithstanding the position of the ground contact or prong extending from the rear surface of the circuit module. Accordingly, when a plug is inserted into a circuit module received in the power block, the ground pin of the plug is uppermost. In the event that the plug is not fully inserted into the circuit module thereby exposing a portion of its electrical contacts, the uppermost exposed plug contact will be a ground pin. Thus, any downwardly falling objects will strike the exposed ground pin and not a live electrical contact. This aspect of the invention provides a significant safety feature since the power module of the present invention, in most instances, will be mounted in a relatively low position such as beneath the bottom of a wall panel. Accordingly, the danger of electrical accidents caused by objects falling downwardly on an exposed live electrical plug contact is avoided by the specific orientation provided by the present invention.

Figure 9:
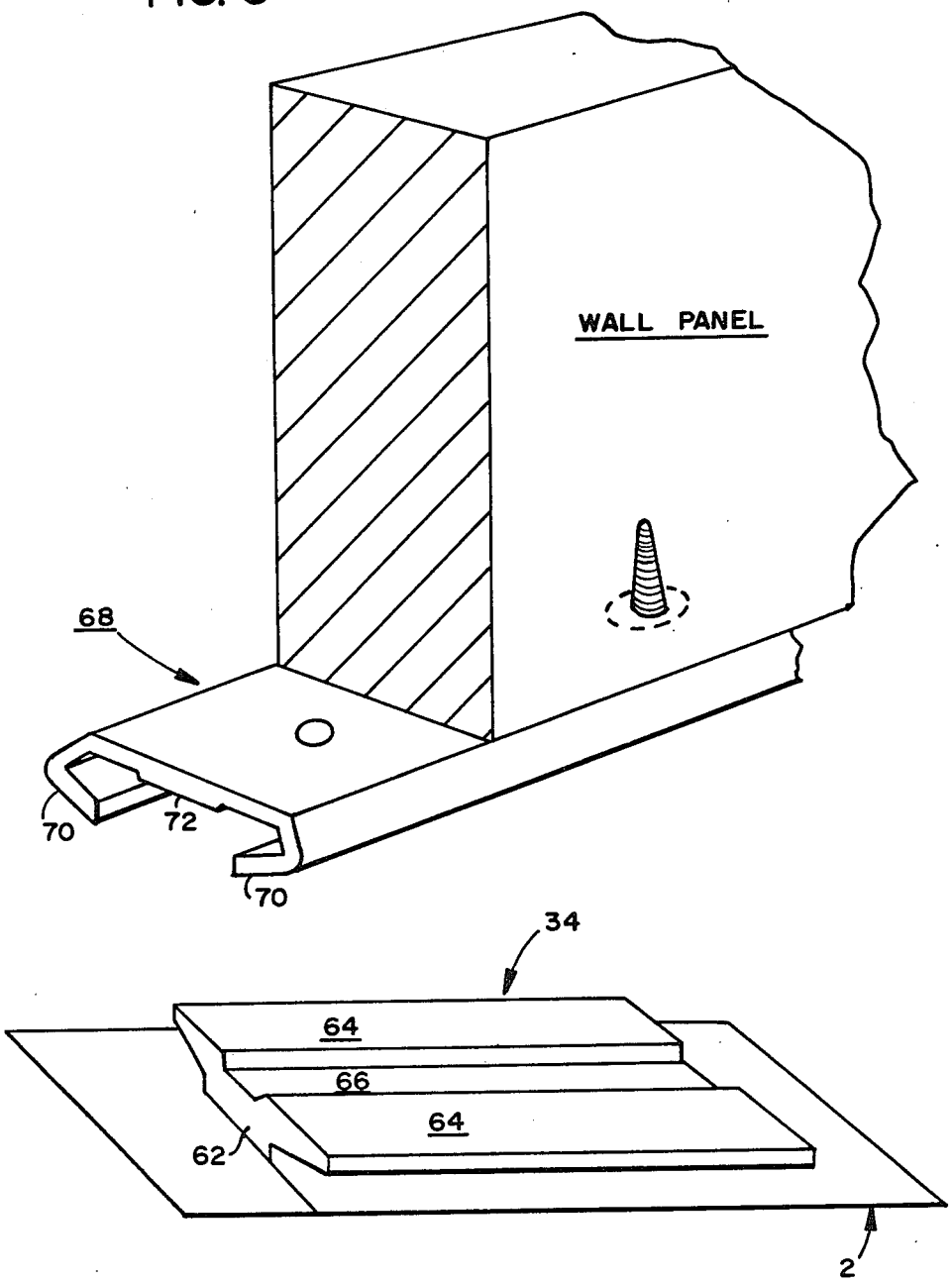
FIG. 9 illustrates the top surface of the power module clearly showing a mounting bar affixed thereto and a mounting bracket adapted to receive the mounting bar for installing the power module.

FIG. 9 of the drawings illustrates in perspective the mounting bar 34 carried on the top surface of the power module 2, as shown in FIGS. 1 and 2. The mounting bar includes a narrow base portion designated as reference numeral 62 extending longitudinally along the power module housing and two longitudinal flange portions 64 extending outwardly from the base 62. A longitudinal channel 66 is defined down the center of the mounting bar. The mounting bar may be integrally formed together with the power module 2, which can be made from a durable plastic, or may be separately affixed to the power module.

Still referring to FIG. 9, a bracket 68 is mounted beneath the bottom of a wall panel, or any other suitable location where the power module is to be mounted. The bracket may be affixed to the panel and the by conventional means such as screws or bolts. The bracket includes folded edges 70 which complement the shape of flanges 64 on the mounting bar. The bracket further includes a centrally located, longitudinally extending, downwardly directed rib 72 which complements the shape of the central channel 66 defined between the flanges of the mounting bar.

It is apparent that the mounting bar may be readily received within the bracket by merely sliding the mounting bar into the bracket. The rib on the bracket is initially aligned with the channel on the mounting bar. Thereafter, the entire power module is slid into the bracket so that the flanges on the mounting bar are received within the folded edges of the bracket. The cooperating relationship between the channel 66 and the rib 72 guides the mounting bar as it is slid into the bracket. The crimped or folded edges 70 of the bracket secure the mounting bar therein to support the entire power module 2 in the bracket. It is thus apparent that the power module may be mounted to or dismounted from the bracket by a mere sliding motion of the mounting bar into the complementary shaped bracket. The expense and labor required by the prior art to mount a power module by conventional means such as screws or bolts is eliminated. Moreover, only the bracket, and not the power module, is permanently affixed to the desired mounting location. Therefore, no permanent mounting operations need be performed on the power module itself.

It is evident that the present invention, as described above, provides many advantageous improvements over the known power modules. Unlike conventional devices, the power module encompassed by one aspect of the present invention provides individual ports for individual circuit modules which are selected by the user of the system. The circuit modules are mechanically interchangeable in that they may be received in any of the ports in the power module, but are electrically distinct and will establish the same predetermined electrical circuit in any port in which the module is inserted. The use of individual circuit modules selectively received in individual ports in the pwoer block provides the user of the system with the capability to balance the electrical load on individual receptacles acruing different types of equipment.

The system of the present invention further advantageously provides three separate circuits formed from seven parallel conductors by which two circuits share a ground and a neutral conductor and one circuit includes an isolated ground and an isolated neutral conductor for establishing an isolated circuit. The isolated circuit may advantageously be used as a "computer circuit" and shielded to prevent harmful electro-magnetic interference from the two other circuits. Separation of the live conductor of the isolated circuit from the live conductors of the convenience circuit by two ground and two neutral conductors further helps reduce the penetration of electro-magnetic interference in the computer circuit.

In a further aspect of the invention, a new tool for removing individual circuit modules from the ports in the power module cooperates with a pre-defined structural relationship between both the circuit modules and the ports in the power module to ensure that the circuit modules may only be removed by authorized personnel possessing the tool. The circuit module is removed in one easy single step by the tool, and eliminates the danger of conventional methods by which electrically conductive probe-like objects are inserted into the power module to pry the circuit module therefrom.

In an additional aspect of the invention, a mounting bar is integrally formed on, or mounted to, the top surface of the power module. A complementary shaped mounting bracket slidably receives the mounting bar on the power module to easily mount the power module in its desired location, eliminating the cost and labor of using conventional mounting means, as for example screws or bolts to mount the power module.

The description of the preferred embodiments of the invention herein is intended to be illustrative only and not restrictive of the scope of the invention, that scope being defined by the following claims and all equivalents thereto.

I claim:

1. A modular power system comprising:

a housing having a plurality of electrical conductors received therein, a plurality of individual ports defined in said housing, each of said ports adapted to receive a single circuit module therein, each of said circuit modules adapted to electrically engage a plurality of said electrical conductors to establish a predetermined electrical circuit when one of said single circuit modules is received in any one of said plurality of ports said housing having at least seven electrical conductors including at least two ground conductors, at least two neutral conductors and at least three live conductors for providing at least three electrical circuits, two of said circuits having common neutral and ground conductors and a third circuit having separate neutral and ground conductors.

2. The modular power system defined in claim 1 wherein each of said circuit modules is substantially physically similar to each other and each of said ports defined in said housing is of substantially the same dimensions such that any of said single circuit modules may be physically received in any of said ports.

3. The modular power system defined in claim 1 wherein each of said ports defines a plurality of slots corresponding at least in number and position to said seven electrical conductors within said housing.

4. The modular power system defined in claim 3 wherein said single circuit modules received in said ports in said housing are adapted to electrically engage a predetermined number of said plurality of electrical conductors in said housing through said corresponding slots in said port.

5. The modular power system of claim 1 further including means for isolating said third circuit from said two other circuits.

6. The modular power system of claim 1 further including means for shielding said third circuit from said other two circuits.

7. The modular power system of claim 6 wherein said third circuit is shielded by surrounding said separate live, ground and neutral conductors forming said third circuit by a metallic foil.

8. The modular power system of claim 7 wherein said metallic foil is adapted to prevent penetration of electro-magnetic radiation generated from said other two circuits.

9. The modular power system of claim 1 wherein said electrical conductors in said housing are arranged such that one of said live conductors is physically separated from the other of said two live conductors by positioning said two ground conductors and said two neutral conductors therebetween.

10. The modular power system of claim 1 wherein each of said circuit modules includes three electrical prongs, said electrical prongs adapted to electrically engage one of said live conductors, one of said neutral conductors, and one of said ground conductors in said housing when said circuit module is received in any port defined in said housing.

11. The modular power system of claim 10 wherein each of said ports in said housing includes a plurality of slots each of which are respectively aligned with said electrical conductors in said housing, and said circuit modules electrically engage predetermined electrical conductors in said housing through said slots when said circuit modules are received in said ports.

12. The modular power system of claim 11 wherein each of said circuit modules establishes a predetermined electrical circuit when said circuit module is received in any of said ports in said housing.

13. The modular power system of claim 12 wherein said predetermined electrical circuit established by any of said circuit modules is determined by the orientation of said electrically conductive members on said circuit module relative to said electrical conductors in said housing when said circuit module is received in any of said ports.

14. The modular power system of claim 13 wherein said orientation of said electrically conductive members on said circuit module relative to said electrical conductors in said housing is arranged such that insertion of any one of said circuit modules in any one of said ports will engage the same electrical conductors in said housing.

15. The system of claim 1 further including means for electrically connecting said housing to a cable.

16. The system of claim 15 wherein said cable includes at least seven electrical wires corresponding to the electrical conductors in said housing.

17. The system of claim 16 further including means in said cable for shielding one of said live wires, one of said neutral wires, and one of said ground wires from the other wires in said cable.

18. The system of claim 1 including a narrow electrical band adapted to being electrically connected to said housing, said band including at least seven wires arranged vertically oriented with respect to each other and corresponding to said at least seven electrical conductors in said housing.

19. The system of claim 18 including means for shielding at least one of said live wires, one of said neutral wires and one of said ground wires in said band from the other of said wires in said band.

20. The system of claim 19 further including at least one drain wire in said band.

21.

The system of claim 1 including:

a mounting bar on said housing, said mounting bar adapted to be received in a mounting bracket by sliding said mounting bar into said mounting bracket, whereby said power block module is removably mounted to and dismounted from said mounting bracket by a sliding movement.

22. The system of claim 21 wherein said mounting bar extends longitudinally along the upper surface of said housing, said mounting bar defining two longitudinal flanges along its opposed edges, said flanges being shaped to be received within complementary configured end sections of said mounting bracket.

23. system of claim 22 wherein said mounting bar defines a longitudinal channel along the upper surface thereof for receiving in said channel a complementary guide rib defined on said bracket for guiding said mounting bar as it is slid into said bracket.

24.

The system of claim 1 wherein:

said circuit module defines three openings for receiving respectively a live conductive member, a neutral conductive member, and a ground member of an electrical plug adapted to be inserted into said circuit module, said circuit module being arranged such that said opening therein for receiving said ground member of said plug is defined above the other of said two openings such that downwardly falling objects will strike said ground member if said plug is not fully inserted into said openings in said circuit module.

* * * * *